United States Patent [19]

Rosenberg et al.

[11] Patent Number: 5,059,960

[45] Date of Patent: Oct. 22, 1991

[54] CONTROL PANEL

[75] Inventors: Daniel J. Rosenberg; Thomas C. Littlefield, both of Rochester, N.Y.

[73] Assignee: Eastman Kodak Company, Rochester, N.Y.

[21] Appl. No.: 945,140

[22] Filed: Dec. 22, 1986

[51] Int. Cl.[5] ..... G03G 15/00

[52] U.S. Cl. ..... 340/111; 340/712; 341/23

[58] Field of Search ..... 340/365 VL, 711, 712, 340/715, 716, 784, 734, 796; 341/23

[56] References Cited

U.S. PATENT DOCUMENTS

| | | | |
|---|---|---|---|
| 3,187,321 | 6/1965 | Kameny | 340/365 VL |
| 3,560,964 | 2/1071 | Bedell et al. | 340/365 VL |
| 3,600,592 | 8/1971 | Mahan et al. | 340/365 VL |
| 3,956,745 | 5/1976 | Ellis | 340/365 VL |
| 4,022,993 | 5/1977 | Shattuck | 340/365 VL |
| 4,078,257 | 3/1978 | Bagley' | 340/365 VL |
| 4,334,219 | 6/1982 | Paulus et al. | 340/365 VL |
| 4,336,530 | 6/1982 | Koike et al. | 340/365 VL |
| 4,359,222 | 11/1982 | Smith et al. | 340/365 VL |
| 4,381,500 | 4/1983 | Urata et al. | 340/365 VL |
| 4,390,892 | 6/1983 | Murakami et al. | 340/715 |
| 4,398,086 | 8/1983 | Smith | 340/365 VL |
| 4,398,819 | 8/1983 | Schron | 340/716 |
| 4,475,806 | 10/1984 | Daughton et al. | 340/715 |
| 4,562,433 | 12/1985 | Biferno | 340/716 |

OTHER PUBLICATIONS

Tannas, "Flat-Panel Displays and CRTs", Van Nostrand Company, New York, 1985, p. 18.

*Primary Examiner*—Alvin Oberley
*Attorney, Agent, or Firm*—Leonard W. Treash, Jr.

[57] ABSTRACT

A control panel includes electronically addressable display means and a removable opaque overlay. The overlay has transparent graphics indicating machine options for primary functions. The machine options are selectively backlit by the display means to indicate a particular option. When the overlay is removed the display means operates in its conventional manner to guide the operator through more complex special features.

14 Claims, 4 Drawing Sheets

CONTROL PANEL

TECHNICAL FIELD

This invention relates to control panels for copiers, printers, or the like.

BACKGROUND ART

Modern equipment such as copiers and printers provide the user with a large number of options. Commonly used options include choices between duplex and simplex (both input and output), several paper supplies or sizes, image reductions, image magnifications, and various post treatments such as collation, stapling, or the like. Many prior art control panels have buttons permanently dedicated to these commonly used "primary functions."

The same equipment may also have a large number of less often used "special" features, such as image shift, the addition of covers, chapterization, slip sheeting, book copying, job stream programming, the copying of tabs, etc.

A control panel with dedicated buttons for all these special features would be impracticably large. To aid the user in using these special features, prior art control panels have been designed using known display technology, for example, passive liquid crystal technology or vacuum fluorescent display technology, to lead the operator, using numerical paging and menus, step by step through the process for setting the machine up for a particular special feature. While such control panels with their dedicated buttons and a separate display means, greatly assist both the less sophisticated and sophisticated operator, the panels themselves are becoming large and costly.

DISCLOSURE OF INVENTION

It is the object of the invention to provide a control panel for equipment such as a copier or printer which is easy to use by the unsophisticated operator for primary functions, is user friendly for the more sophisticated operator using special features, is relatively compact and is inexpensive to manufacture.

This object is accomplished by a control panel having an electronically addressable display means, for example, a backlit light transmissive liquid crystal display panel, and an overlay for said display means. The overlay has light attenuating portions indicating operator options. A particular option is indicated by means for selectively actuating the electronically addressable display means to backlight the corresponding light attenuating portion.

According to a preferred embodiment, the panel has first and second modes of operation. In the first mode of operation the overlay overlies the display means and is selectively back-lit by it. In this mode the display means is used to selectively highlight operator options which are defined by text or graphics permanently contained in the overlay. In the second mode the overlay does not overlie much or any of the display means and the display means can then function in its usual manner to directly display information.

This invention has the advantage of using a relatively coarse resolution, low information and inexpensive display means for special features, but, in the same space, using a comparatively high resolution, high information content overlay for the primary functions used in normal operation. The lower resolution display means makes the panel less expensive than a display panel having resolution as high as the overlay. Because two modes use the same space, the panel is compact.

Another advantage of the invention is that the overlay stays in place overlying the display means during normal operation. For a person to get into the special features requires the separate distinct act of removing the overlay. 90–95% of the use of a copier is with the primary functions outlined on the overlay. These functions require little training. The requirement that the overlay be removed for the other more complicated special features separates those features, thereby suggesting their use only with some training or close attention.

Another advantage of the invention is that design variations or changes often require only inexpensive variations in the overlay. For example, most language variations can be handled by changes in software and the overlay.

According to a preferred embodiment of the invention, the display means is a liquid crystal panel set up as a light valve for an electroluminescent sheet positioned to the rear of and co-extensive with it. Such devices are quite inexpensive, but have a relatively low number of pixels per inch. They also allow a certain amount of light leakage all the time. This latter characteristic of liquid crystal displays provides the feature that the options which are not being highlighted by the liquid crystal back lighting are nevertheless slightly backlighted so that they can be seen by the operator. Thus the operator looking at the overlay sees all his options faintly with the active one highlighted. This feature is also provided in the prior art, but by the more expensive approach of supplying separate high and low voltages to ordinary illuminating means.

According to another preferred embodiment of the invention, the panel can be portable by providing a battery pack, a handle and a suitable mechanism for communicating with the equipment that the control panel is to control.

According to another preferred embodiment of the invention the overlay has a transparent area that permits normal use of the display means to give messages while the overlay is in place. In this embodiment when the overlay is removed the display means has considerably more area to use for display.

According to another preferred embodiment the overlay is arranged with the sets of options listed in columns, rows or diagonals. A control button is located at the end of each column, row or diagonal which button can be actuated to cause the backlighting to move up, down or across the column, row or diagonal. When the overlay is removed in mode 2, the buttons can be used to interact with information (for example menus) presented in the display means.

According to another preferred embodiment, the overlay is formed as part of a scrolled flexible member which also includes a transparent portion which overlies the display means when the panel is in its second mode. This places the overlay out of sight when not being used. The overlay can be returned by the operator or automatically returned either on cycle up or after a set period of machine nonuse. In this embodiment it is convenient to include more than one overlay. For example, the flexible member could include overlays formatting jam clearance information and help information in addition to the primary functions panel. The "special features" portion need not be entirely transparent, but can include formatting graphics.

BRIEF DESCRIPTION OF THE DRAWINGS

In the detailed description of the preferred embodiment(s) of the invention presented below, reference is made to the accompanying drawings, in which.

BEST MODES OF CARRYING OUT THE INVENTION

Figure 1:
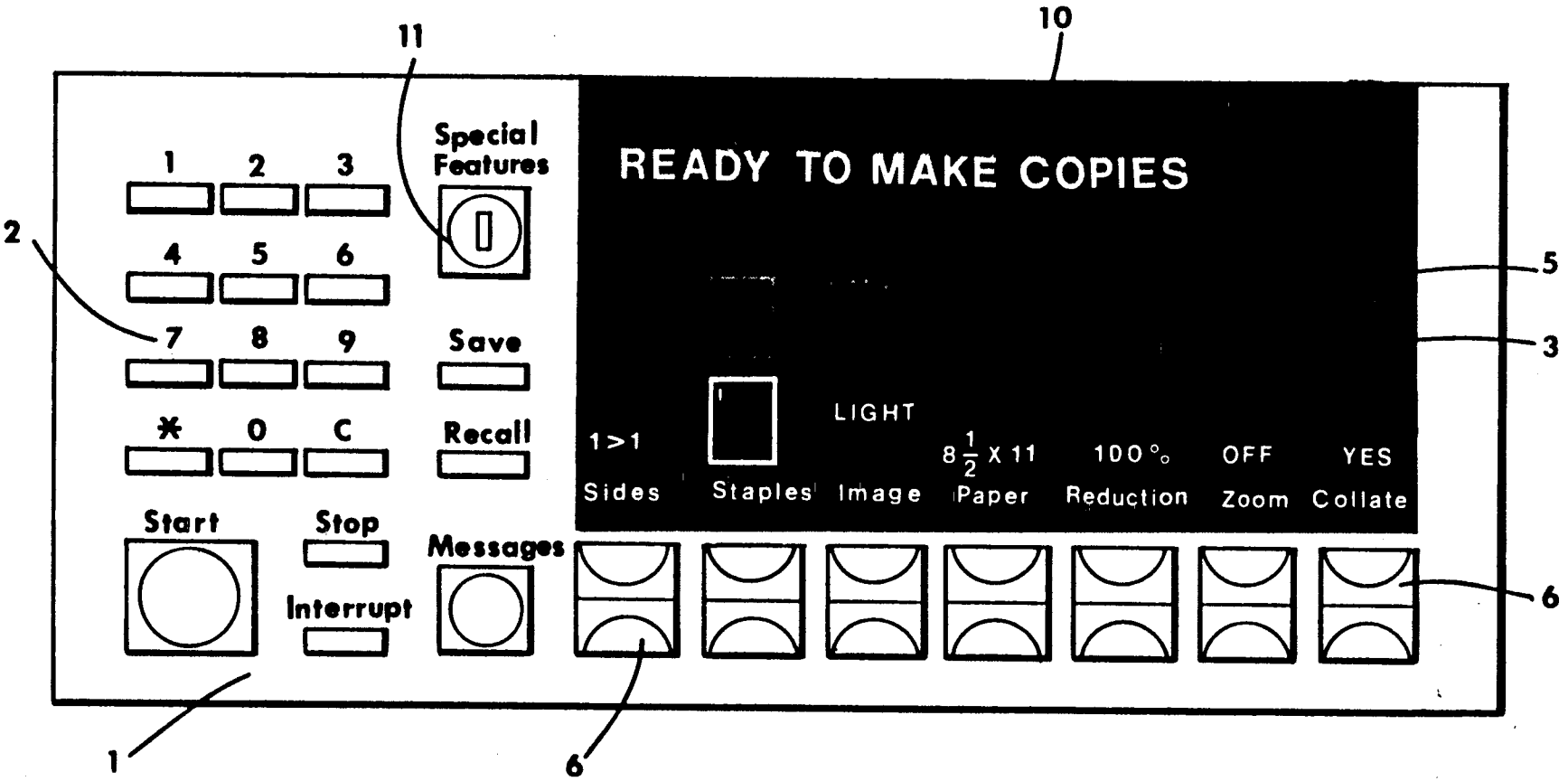
FIG. 1 is a front view of a control panel constructed according to the invention with an overlay in position overlying a display means.
Figure 2:
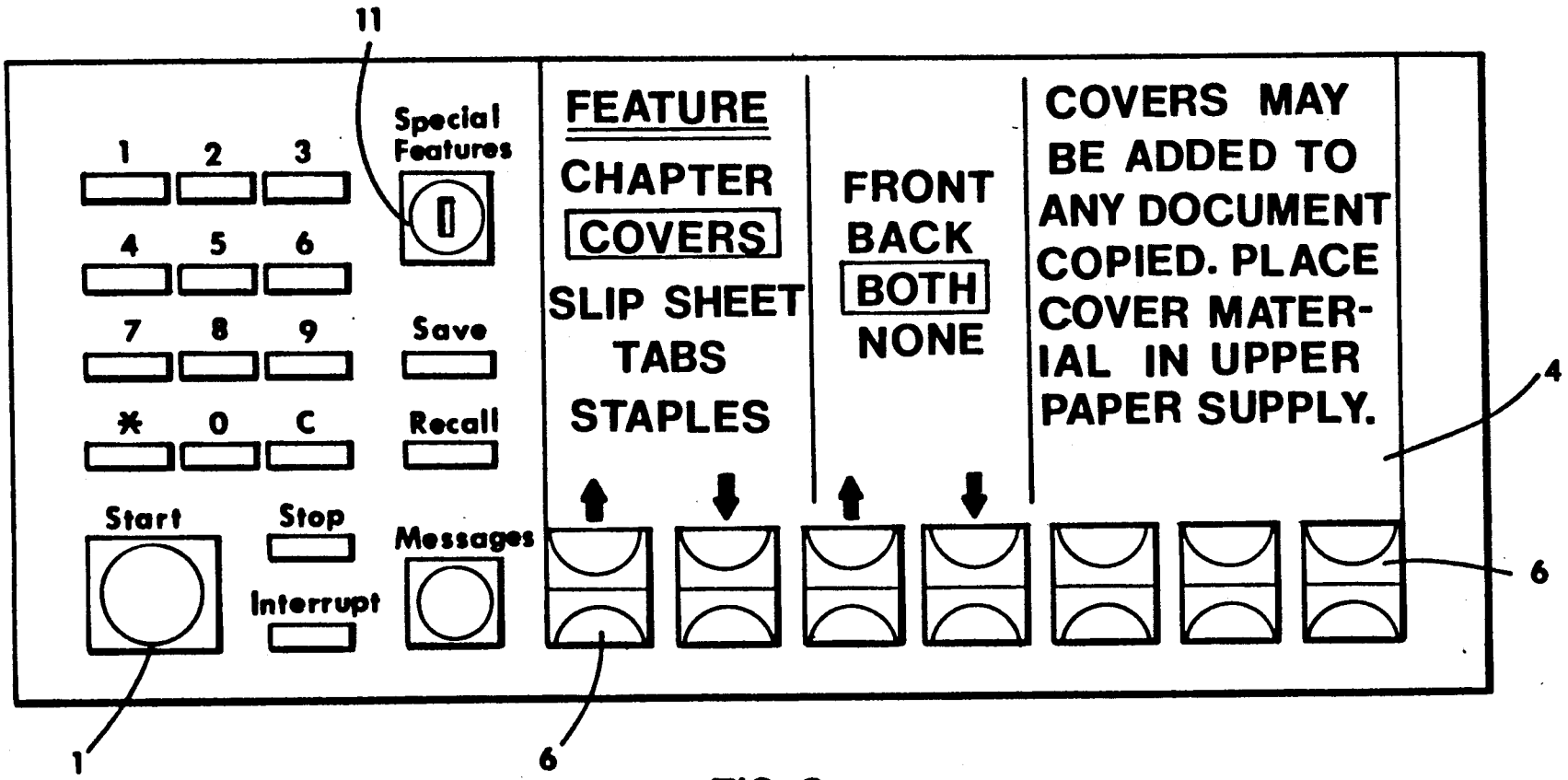
FIG. 2 is a front view of the control panel shown in FIG. 1 with the overlay not overlying the display means.
Figure 3:
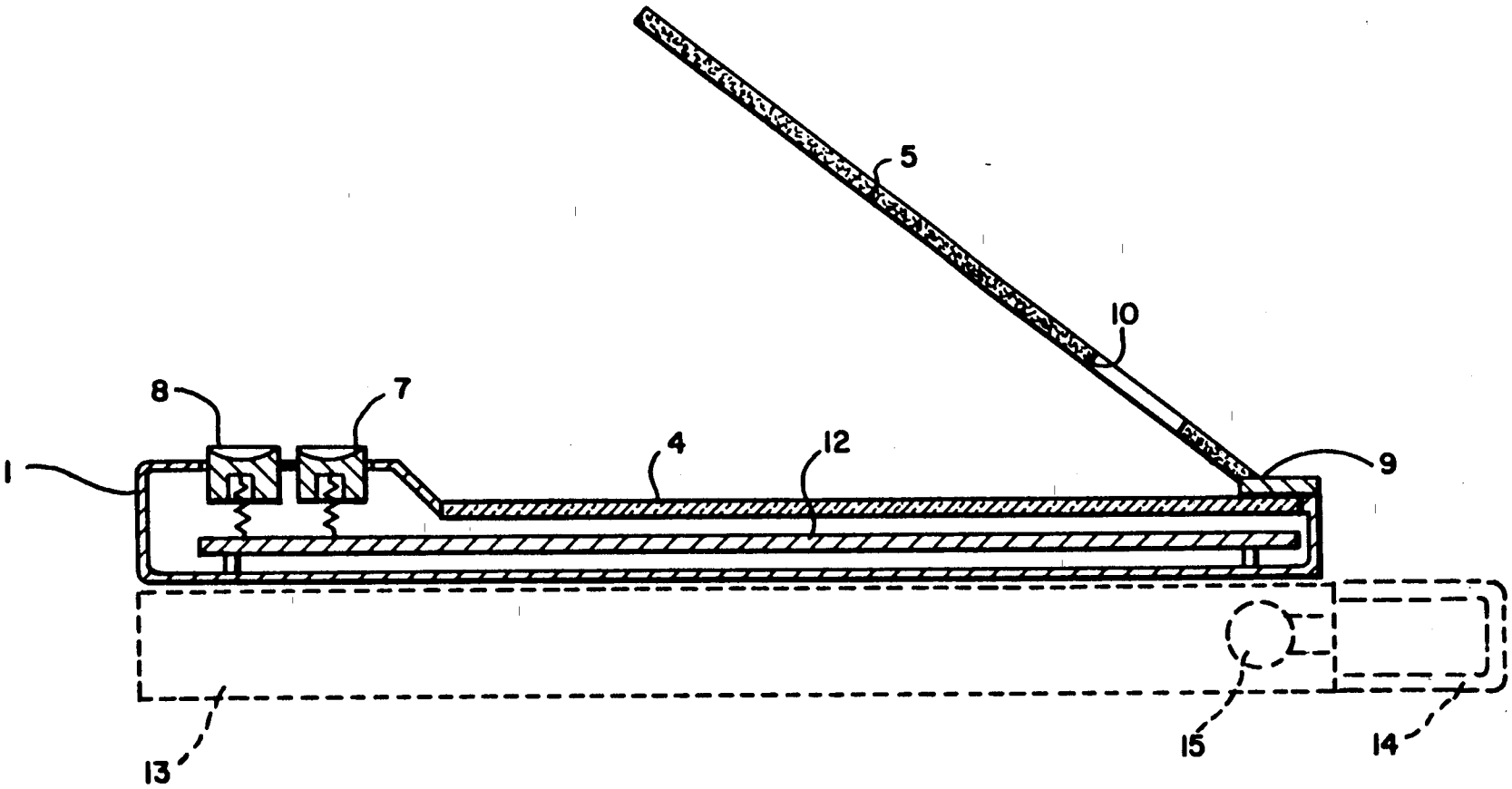
FIG. 3 is a schematic side cross-section with some parts in phantom of a control panel substantially the same as that of FIGS. 1 and 2 with the overlay raised and many of the parts shown schematically.

According to FIGS. 1-3, a control panel 1 includes an operator input portion 2 and a display portion 3.

The operator input portion 2 includes normal numerical input keys or buttons and other buttons, including "start", "stop", "interrupt" buttons and, in this instance, a button 11 for "special features" and a button for "messages". The display portion 3 includes a display means 4 (FIGS. 2 and 3), an overlay 5 for the display means, and a set of control buttons for the display means. The control buttons are shown in FIGS. 1 and 2 as a set of seven two-way (or toggle) buttons 6 adjacent the bottom of the display means which buttons if pushed up will have one effect and if pushed down will have another effect. In FIG. 3 each of these buttons is shown instead as two buttons, 7 and 8. Pushing button 7 will have the same effect as pushing one of the two-way buttons up, and pushing button 8 will have the same effect as pushing one of the two-way buttons down.

A printed circuit board 12 is shown in FIG. 3 directly behind both the display means 4 and the buttons 7 and 8. The printed circuit board contains a central processing unit, memories and other electronics associated with the display portion of the control panel.

The display means 4 can be any known electronic display means, including a CRT or an array of LEDs. However, in its preferred form it is of a construction presently available on the market that includes a liquid crystal graphic display portion backlit by a light source such as an electroluminescent sheet of material. The liquid crystal contains pixels that operate as light valves which are separately electronically addressable to either permit light to pass or not to permit light to pass.

The overlay 5 is made of ordinarily transparent material such as glass or plastic. It is mountable for pivotal movement about one end 9 between a position overlying the display means 4 and a raised position not overlying the display means. Preferably, in the raised position the display means is entirely visible.

The overlay 5 contains light attenuating portions which are capable of indicating operator options in response to backlighting of the overlay. Preferably, the overlay is made opaque or translucent with transparent or cutout text or graphics. The area behind the transparent graphics is then selectively backlit by actuation of the display means directly behind that area. For this function, the control buttons 6 (or 7 and 8) control the backlighting. The transparent graphics in the overlay are arranged in either rows, columns or diagonals with a button at the end of each row, column or diagonal which, when actuated moves the highlighting up, down or across the row, column or diagonal.

For example, as shown in FIG. 1, the overlay is generally opaque. It has transparent or translucent portions which make up a leftmost column of graphics. At the bottom of this column is the word "sides" in the overlay. Various options are listed in the column to tell the operator whether he is going from duplex originals to duplex copies (2—2) or simplex to simplex (1—1) or combinations thereof. The word "sides" is printed on the overlay in a manner distinguishing it from the selectable choices. The button at the bottom of the column controls which of the options is heavily backlit.

Because this type of liquid crystal display means has a small amount of leakage even when that portion of the display is not actuated the options not chosen are lightly visible to the operator. This allows the operator to see all of his options and note by the highlighting the one that has been picked. This latter feature is known generally in the prior art, but has been accomplished by the more expensive expedient of applying separate voltages to separate illumination sources for each option.

The overlay contains a cutout or totally transparent area 10 which allows direct operator viewing of the display means thereby permitting messages to the operator, using the display means in its normal electronically addressed mode.

The above described operation is for the normal or first mode of the control panel. The primary functions of the copier or printer that the control panel is controlling are all contained in the graphics of the overlay. The overlay, of course, is of much higher resolution than an ordinary liquid crystal display means and therefore can contain all options of all of these normal features.

When the operator wishes to use a more sophisticated and less commonly used feature, he presses the special features button 11 shown in FIGS. 1 and 2. This causes the overlay to pivot about end 9 (by spring or motor, not shown) to a position in which the entire display means 4 is visible as shown in FIG. 2. Pressing the special features button also switches the electronics to prepare the apparatus for special features. In this mode, the entire display means is used for text and graphics as is well known in the art. The control buttons are also switched over to special features and can be used to scroll menus up and down and otherwise to interact with the information associated with the special features.

For example, as shown in FIG. 2 the display shown by the display means is divided into three portions. The leftmost portion is a menu entitled "features" and can be scrolled by one of the two control buttons directly below it as directed by arrows in the display itself. The second third of the display means is another menu which offers the operator the choices available from the feature that is presently picked from the features menu. The control buttons below this second menu can control which item is picked for that feature. The rightmost third of the display means may provide the operator feedback and status information based on the picks he has made from the previous two menus. It may also have a message with more information as to how to use that special feature or as to problems that might be created by it.

Overlay 5 can be moved back into its position overlying the display means by a motor or by the operator rotating it against the opening spring to a latched (FIG. 1) position. When the operator moves the overlay 5 back into the FIG. 1 position, the printer or copier is automatically switched into its primary functions operation as defined by the overlay.

Figure 4:
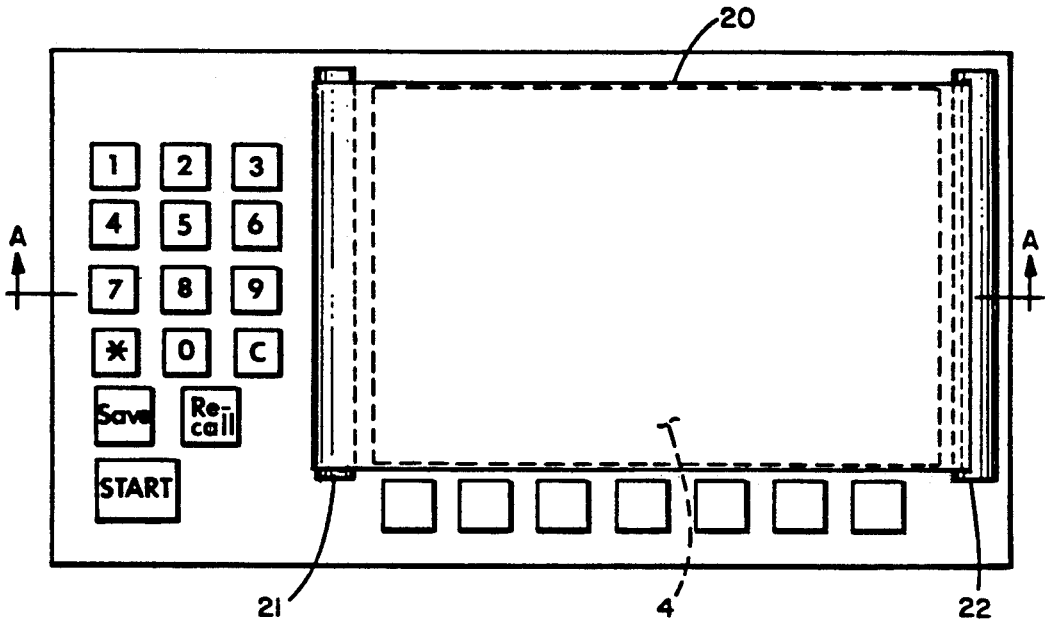
FIG. 4 is a schematic top view of a control panel constructed according to an alternative embodiment of the invention with portions missing for clarity of illustration.
Figure 5:
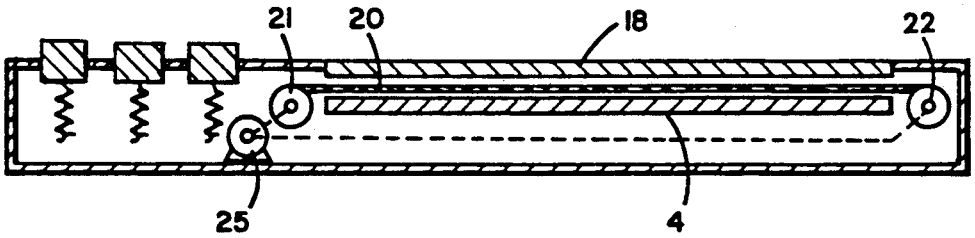
FIG. 5 is a schematic cross section taken along line A—A in FIG. 4.

FIGS. 4 and 5 show another embodiment of the invention in which the overlay is part of a longer flexible element 20 positioned in the form of a scroll. Flexible element 20 is wrapped around takeup rollers 21 and 22 positioned on the left and right sides of the display means 4, respectively. A motor 25 is connected to rollers 21 and 22 to drive them to feed flexible element 20 back and forth across a position overlying display means 4. Flexible element 20 is protected by a glass cover 18 (shown only in FIG. 5) which can also hold it against the display means 4.

In mode 1 the primary functions overlay portion of flexible element 20 overlies display means 4. When the operator wishes to use a special feature, he actuates special features button 11 (FIGS. 1 and 2). Motor 25 is activated and flexible element 20 is scrolled onto takeup roller 22 until the primary functions overlay portion of flexible element 20 has been replaced by a transparent portion. To return the overlay to a position overlying the display means, motor 25 rotates takeup roller 21 to replace the transparent portion of the flexible element 20 with the overlay portion.

With this embodiment more than one overlay can be used. For example, the flexible element 20 can be a flexible, acrylic plastic or polyester film onto which are screened the "primary functions" overlay described above, a "jam" overlay, a "help" panel overlay and the substantially transparent panel for special features. The motor scrolls flexible element 20 to the appropriate overlay upon command from the machine. In environments that are multilingual, this multi-overlay embodiment would permit two or more primary functions panels (or any other panel), one for each commonly used panel language, together with a mechanism for the operator to pick the language in which he chooses to work.

This particular structure (FIGS. 4 and 5) adds a small amount of expense to the control panel, but it improves the appearance of the control panel as well as allowing more overlays.

Note that the invention can be used with no totally transparent panel. For example, a "special features" panel could include formatting (the arrows shown in FIG. 2) for the display means.

Because a printer or copier would generally operate with the primary functions overlay in place in excess of 90% of the time, appropriate programming is provided to automatically move the primary functions overlay into position (mode 1 operation) when the use of a different panel is finished. This can be done in the FIGS. 4 and 5 embodiment by actuating motor 25 in response to turning the machine on or off or after a predetermined time delay after a particular job is finished.

The overlay also can add color to a black and white display means by using one or more colored materials for the overlay or by screening colored materials onto it, or onto the transparent portion of the flexible element 20.

The overlay also can include structure for providing a "touch screen" feature to this invention. More specifically, tiny wire switches, which close in response to touching, are imbedded in the overlay, in a manner well known in the art, to provide an alternative to control buttons 6.

The special features button shown in FIGS. 1 and 2 also has a key slot to take a special information key containing a magnetic or other memory which allows the operator to identify himself to the control panel. The save and recall keys are useful for certain special features in which particular copying or printing programs can be placed in memory and called back up by proper use of the keyboard.

The messages button shown in FIGS. 1 and 2 allows the operator to obtain more information, for example, about jams or other problems associated with the machine. Such messages can be displayed on the full display means when operating in mode 2 or on the smaller portion of the display means visible through cutout 10 when operating in mode 1.

The control panel shown in FIGS. 1 and 2 shows a column labeled "zoom". This allows the operator to push the control button 6 for that column upward or downward, to gradually scroll up or down from one magnification-reduction to another. That scrolling can be shown in the cutout area 10. It could also be shown in a special cutout window directly above the zoom column.

Variations, for example, language variations and model variations as well as design or color changes can often be made by inexpensive variations and changes only in the overlay.

FIG. 3 shows in phantom an embodiment in which the control panel is made portable by including a battery pack 13, a handle 14 and a suitable device 15 for communicating with the copier or printer.

Inexpensive liquid crystal display means commonly function at approximately 50 pixels per inch. This is adequate when operating in mode 2 when dealing with a specific special feature with ample programming to move the operator from one choice to the next. However for normal operation of the copier it is not nearly high enough resolution to put all the primary functions in the space desired. The overlay can be made with its resolution as fine as the operator can conveniently read. Thus, the invention provides a compact and inexpensive control panel with a large amount of information provided in a small space when it is operating in its normal mode but with the flexibility of the display panel when operating in its special feature mode.

The invention has been described in detail with particular reference to a preferred embodiment thereof, but it will be understood that variations and modifications can be effected within the spirit and scope of the invention as described hereinabove and as defined in the appended claims.

We claim:

1. A control panel for a copier, printer or the like, comprising:

electronically addressable display means, an overlay for said display means, said overlay including permanet light attenuating portions indicating operator options in response to backlighting, and means for indicating a particular option by actuating the electronically addressable display means to selectively backlight the light attenuating portion indicating that option, said panel having first and second modes of operation in which:

in said first mode, said overlay overlies the display means and the display means is actuable to selectively backlight operator options permanently indicated in said overlay, and in said second mode, said overlay does not overlie the display means and the display means is actuable to directly display information.

2. A control panel according to claim 1 wherein the overlay has an opaque portion, said light attenuating portions being formed as transparent or cutout text or graphics in the opaque portion.

3. A control panel according to claim 1 wherein the overlay also has a transparent portion permitting use of the display means to directly display information.

4. A control panel according to claim 1 wherein said light attenuating portions for a particular set of options are arranged in a row, column or diagonal and there is an operator actuatable means aligned with said row, column or diagonal actuatable to control indication of options in that column, row or diagonal.

5. A control panel according to claim 4 wherein said operator actuable means is also actuable to control the display means when in its second mode.

6. A control panel according to claim 1 wherein said panel is settable between modes one and two by raising the overlay and includes means responsive to raising and lowering of said overlay to set associated equipment electrically for the appropriate mode.

7. A control panel according to claim 1 wherein said overlay is part of a larger flexible element including a substantially transparent portion and wherein said panel includes means for scrolling said element to position either said overlay or said transparent portion over said display means.

8. A control panel according to claim 1 or 6 wherein said panel includes means to automatically switch to said first mode in response to a particular condition of associated equipment.

9. A control panel according to claim 1 or 6 further including a plurality of overlays, and means for selectively positioning each of the overlays over the display means.

10. A control panel comprising a backlit electronically addressable liquid crystal display means and a partially transparent or translucent, partially opaque or translucent overlay for said display means said opaque and transparent portions defining operator options, said panel having first and second modes of operation, in which in said first mode, said overlay is backlit by the display means, with the display means being actuatable to selectively highlight operator options in said overlay, and in said second mode, said overlay does not overlie the display means and the display means is actuable to directly display information.

11. A control panel according to claim 10 wherein said operator options are lightly backlit in said first mode when not highlighted.

12. A control panel according to claim 1 wherein said electronically addressable display means includes an array of separately addressable pixels which function in the first mode of said panel by emitting light behind the light attenuating portion corresponding to the operator option to be indicated and function in said second mode by emitting light from specific pixels located in a pattern directly representative of information.

13. A control panel for a copier, printer or the like, comprising:

electronically addressable display means, an overlay for said display means, said overlay including permanent light attenuating portions indicating operator options in response to backlighting, means for indicating a particular option by actuating the electronically addressable display means to selectively backlight the light attenuating portion indicating that option, and means for directly displaying information by actuation of said electronically addressable display means without attenuation by said overlay.

14. A control panel for a copier, printer or the like, comprising:

electronically addressable display means including an array of separately addressable pixels, an overlay for said display means, said overlay including permanent light attenuating portions indicating operator options in response to backlighting.

means for indicating a particular option by actuating the electronically addressable display means to emit light behind the the light attenuating portion corresponding to the operator option to be indicated, and means for directly displaying information by actuation of said display means to emit light from specific pixels located in a pattern directly representative of such information without attenuation by said overlay.

* * * * *